United States Patent [19]

Hwa

[11] 3,977,898

[45] Aug. 31, 1976

[54] METHOD FOR CLEANING A SUPPORT SURFACE

[75] Inventor: Stephen C. P. Hwa, Penfield, N.Y.

[73] Assignee: Xerox Corporation, Stamford, Conn.

[22] Filed: July 23, 1975

[21] Appl. No.: 598,445

Related U.S. Application Data

[62] Division of Ser. No. 482,726, June 24, 1974, Pat. No. 3,918,809.

[52] U.S. Cl. ..... 134/6; 15/93 R; 15/97 R; 15/256.5; 15/256.51; 15/256.53; 355/15

[51] Int. Cl.[2] ..... B08B 1/02

[58] Field of Search ..... 134/6; 355/15; 15/256.5, 256.51, 256.53, 93 R, 97 R

[56] References Cited

UNITED STATES PATENTS

| | | | |
|---|---|---|---|
| 3,552,850 | 1/1971 | Royka et al. | 355/15 |
| 3,634,077 | 1/1972 | Sullivan | 355/15 X |
| 3,660,863 | 5/1972 | Gerbasi | 355/15 X |
| 3,742,551 | 7/1973 | Oriel | 355/15 X |
| 3,759,220 | 9/1973 | Saito et al. | 118/DIG. 23 |
| 3,811,914 | 5/1974 | Saito et al. | 355/10 X |

FOREIGN PATENTS OR APPLICATIONS

| | | | |
|---|---|---|---|
| 2,111,509 | 9/1971 | Germany | 355/15 |

*Primary Examiner*—S. Leon Bashore
*Assistant Examiner*—Marc L. Caroff
*Attorney, Agent, or Firm*—James J. Ralabate; Donald C. Kolasch; Ernest F. Chapman

[57] ABSTRACT

Method for cleaning liquid developer from upwardly moving support surfaces, such as reuable surfaces used for carrying latent electrostatic images. Surfaces are cleaned by a wiper blade and at least one scraper blade adapted to engage the support surface. The wiper blade acts upon the support surface upstream of the scraper blade.

4 Claims, 2 Drawing Figures

METHOD FOR CLEANING A SUPPORT SURFACE

This is a division of application Ser. No. 482,726, filed June 24, 1974 now U.S. Pat. No. 3,918,809.

BACKGROUND OF THE INVENTION

This invention relates to cleaning material from a support surface, and more particularly, it relates to an apparatus and method for removing liquid developer from a photoconductive or other surface.

In the development of electrostatic latent images where liquid developers are used to develop the image on the reusable photoconductor surface or on a reusable interposition surface, liquid developer remains on the surface after the developer image is transferred to a substrate. In these processes and apparatuses where the surface is reused to develop subsequent images, the residual liquid developer must be removed therefrom to such an extent that the residual developer will not interfere with subsequent imaging causing streaks and other image or non-image patterns and smudges of developer which transfer to subsequent substrates. In order to accomplish sufficient removal of the residual developer so that streaking and smudging of subsequent prints is eliminated, several prior art methods have been attempted, but they have resulted in failure. Wiper blades are commonly used to remove the residual liquid developers from these and other support surfaces.

U.S. Pat. No. 3,660,863 issued to Gerbasi on May 9, 1972, discloses a scraper blade acting on a xerographic drum for removing particulate toner material from the drum. In Gerbasi, the cutting edge of the blade, that is, the edge of the blade formed by the upper face surface or top surface and the front side surface, is positioned slightly below the horizontal center line of the drum and the cutting edge is held in a manner to readily cut or chisel the particulate toner material from the drum surface. This configuration is suitable for particulate toner material, however, when used for cleaning liquid developers from a support surface which in operation moves uphill, problems are encountered in disposing of the liquid cleaned from the surface. The liquid runs back over the uncleaned part of the surface and drips therefrom at random positions.

Blade cleaning is also described by Royka et al in U.S. Pat. No. 3,552,850 wherein at least one self-adjusting flexible cleaning blade for pressure contact cleaning of the imaging surface is shown. In Royka et al, the leading edge of at least one cleaning blade is preferably positioned to form an acute angle of less than about 90° and greater than about 20° with the confronting portion of the imaging surface or plane tangent to the imaging surface at the line of blade contact to clean particulate toner from photoconductive members when means to supply a dry solid lubricant to the imaging surface are provided. This cleaning technique which is primarily a wiping action, is operable for particulate toner, but when liquid developers are used, streaking of the support surface with developer due to the interference of the intimate contact between the wiper blades and the support surface from debris, remains a problem. Furthermore, the wiping action does not suitably remove the liquid developers from the surface.

In accordance with the present invention, cleaning blades may be designated as scraper blades or wiper blades. A scraper blade is defined as one wherein the stem extends towards the tip in the upstream direction of the drum's movement and when pressed against the drum exerts a chiselling action on the material (liquid developer and debris) on the drum surface.

A blade which in operation is pressed against a support surface so that it is bent along its length in the downstream direction of the drum motion has a wiping action as it tends to be lifted up by material moving with the drum surface. A wiper blade is defined in accordance with the present invention as one in which the stem extends in the downstream direction of the drum motion. As used herein, upstream and downstream refer to drum motion.

OBJECTS OF THE INVENTION

It is an object of this invention to provide an apparatus and method for improving the cleaning of reusable surfaces used in electrostatic copying machines employing liquid developers for development of the image.

Another object of this invention is to provide an apparatus and method to improve the removal of liquid developer from reusable surfaces when at least one scraper blade is used as the cleaning blade at the upward or uphill portion of the reusable surface.

SUMMARY OF THE INVENTION

These and other objects are accomplished by providing an electrostatographic reproduction apparatus having a movable support surface, a portion of which moves in operation in an upward direction, means for forming a latent electrostatic image on said surface, means for presenting liquid developer to said latent image to develop the image, means to transfer the developed image to a sheet of support or transfer material and cleaning means to clean material remaining on the support surface after transfer, and a drive mechanism to move the support surface past said means in succession, the cleaning means comprising at least one scraper blade adapted to engage the support surface on said upwardly moving portion and a wiper blade acting on the support surface upstream of the scraper blade. A second and additional scraper blade may be used to clean material from the support surface which has passed between the first scraper blade and the support surface due to the accumulation of debris between the first scraper blade and the support surface.

According to the present invention, the dual blade system eliminates the problem caused by the accumulated liquid developer on the surface running back over the uncleaned part of the surface and dripping off the surface at random positions. The wiper blade catches the liquid developer scraped from the surface and diverts it from the support surface to the wiper blade where it can be collected in the sump or otherwise disposed of at one point.

There is also provided a method of cleaning liquid developer and debris from the uphill portion of a support surface comprising the steps of contacting the support surface having liquid developer thereon with a wiper blade and thereafter contacting the support surface with at least one scraper blade to divert the liquid developer removed by the scraper blade from the surface to the side of the wiper blade adjacent the scraper blade. This causes the liquid developer to flow across the wiper blade so that it can be collected in a sump or otherwise suitably disposed.

In essence, there is described a cleaning apparatus for cleaning material from an upwardly moving support surface comprising a scraper adapted to engage the support surface and a wiper blade acting on the support surface upstream of the scraper blade.

By uphill portion of a support surface is meant that portion of a support surface which moves in an upward direction when the support surface is in motion.

Additional objects of this invention will become apparent to those versed in the art of electrostatic copying machines in view of the following detailed description of the method and apparatus taken in conjunction with the accompanying drawings in which preferred embodiments of the apparatus are shown.

DESCRIPTION OF THE PREFERRED EMBODIMENTS

Figure 1:
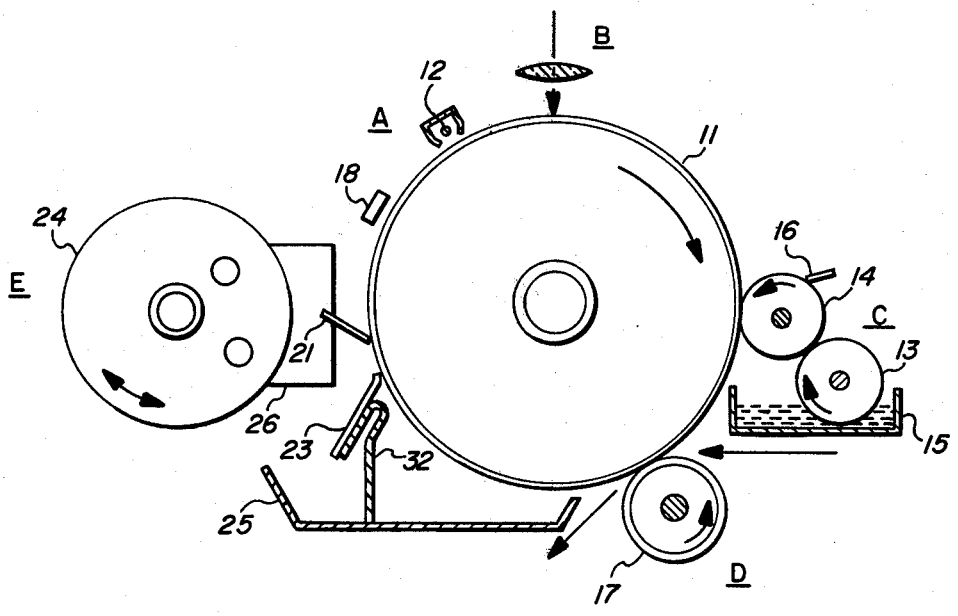
FIG. 1 shows a typical example in the form of a schematic sectional view of an electrostatographic reproduction apparatus having a single scraper blade and a single wiper blade.
Figure 2:
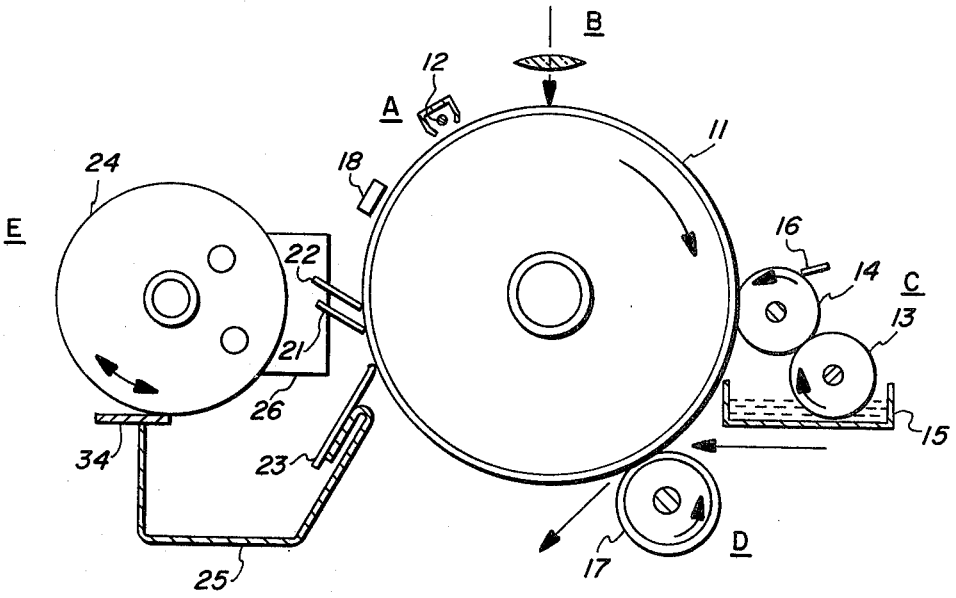
FIG. 2 shows a schematic sectional view of an electrostatographic reproduction apparatus having dual scraper blades and a single wiper blade.

In the copying apparatus illustrated in FIGS. 1 and 2 a copying drum 11 having a photoconductive surface is rotated in the direction of the arrow about its axis past a number of processing stations. The copying cycle starts at the charging station A wherein a corona discharge device 12 is energized to a high potential to apply charge to the drum surface. The drum then passes to the exposure station B at which a flowing image of a document is projected onto the charged drum surface by an optical system (not shown) to produce an electrostatic latent image. The image flows so that it moves in synchronism with the moving drum surface. The latent image passes to the development station C at which liquid developer is applied from a reservoir 15 by means of rolls 13 and 14. The roll 13 is a supply roll whose lower portion dips into the liquid in the reservoir 15 and whose upper portion is spaced by (for example) 0.25 mm from the upper roll 14 which has its surface shaped with a helical groove. The roll 14 is provided with a flexible doctor blade 16 which removes liquid from the groove to below the groove upper edges due to the deformation of the blade into the groove. The developer is attracted by electrostatic attraction from the remote part of the groove to the latent image across the gap between them to develop the image. An example of this method of development is described in detail in U.S. Pat. No. 3,084,043 issued to Robert W. Gundlach, which is incorporated herein by reference, wherein there is claimed a method of development in xerography comprising positioning close but spaced from an electrostatic latent image on an image bearing surface a substantially continuous film of electrically conductive ink comprising a homogeneous liquid solution, providing flow aiding elements in physical contact between said ink and said image bearing surface, and applying a bias to said ink whereby ink moves along said flow aiding elements and develops said electrostatic latent image.

A sheet of paper is fed to a transfer station D by sheet feed apparatus (not shown) to move in synchronism with the drum and is pressed against the drum surface by a transfer roll 17 so that the developed image is transferred to the paper which is then conveyed away from the transfer station through a chute (not shown). Any material remaining on the drum after the transfer station must now be cleaned off at the cleaning station E. After cleaning, electroluminescent strip 18 floods the drum surface with light to discharge any remaining charges, so that the drum can pass onto the charging station for the beginning of the next cycle. A drive mechanism to move the support surface past the various stations in succession and to move various other rolls is not shown. Means to move these various surfaces can be readily provided by one skilled in the art.

At the cleaning station in FIG. 1, there is provided scraper blade 21. The scraper blade is mounted on supporting block 24 which can be moved so that scraper blade 21 can be disengaged from drum 11 when the blade is not in use. The arrows in supporting block 24 in FIG. 1 indicate that it may be rotated to engage or disengage the scraper blade and the support surface as desired. If the blade 21 is left pressing hard against the stationary drum 11, the photoconductive surface may be deformed and the blade may acquire a permanent set.

In FIG. 1, wiper blade 23 on support member 32 is positioned so that it engages drum 11. As illustrated in FIG. 1, wiper blade 23 permanently engages drum 11, however, wiper blade 23 may be suitably mounted to disengage from drum 11 as desired (not shown) in FIG. 1. In the embodiment shown in FIG. 1, the wiper blade is mounted in sump 25. Sump 25 is located below the scraper blade and wiper blade to catch the liquid from the blades. When the wiper blade 23 removes quantities of liquid developer from drum 11 so that liquid developer flows upstream on drum 11 (in the direction of the bottom of drum 11 in FIG. 1), it is preferred that sump 25 extend to the bottom center of the support surface on drum 11 to collect the liquid developer which runs from the vicinity of wiper blade 23 down the surface of the drum and drips into the sump below it.

In accordance with the present invention the wiper blade 23 and scraper blade 21 are mounted in the uphill direction of the drum from bottom center of drum 11 to top center of drum 11 in the direction of the arrow. Wiper blade 23 must engage the support surface of drum 11 upstream from scraper blade 21 to effectively remove the liquid developer and debris which the scraper blade scrapes from the surface.

The surface of drum 11 is cleaned by contacting the uphill portion of the support surface with a wipe blade and thereafter contacting it with at least one scraper blade. In FIG. 1, as the scraper blade 21 cleans liquid developer and debris from the uphill portion of the support surface on drum 11, the liquid developer collects and accumulates on the upstream side of blade 21 until it runs down the surface (upstream) where it collects on the downstream side of wiper blade 23. The liquid developer accumulates on the downstream side of wiper blade 23 until it runs down blade 23 and into sump 25. Thus, wiper blade 23 prevents liquid developer and debris removed from the support surface by blade 21 from passing upstream of the wiper blade.

At the cleaning station in FIG. 2, there are provided two scraper blades 21 and 22. The scraper blades are mounted on supporting block 24 which can be moved so that the scraper blades engage or disengage drum 11. The arrows in block 24 in the drawing indicate that the block may be rotated to engage or disengage the scraper blades and the support surface as desired. If the blades are left pressing hard against the stationary drum, the photoconductive surface may be deformed, and the blades may acquire a permanent set.

In FIG. 2, there is illustrated wiper blade 23 mounted on one edge of sump 25 located below the scraper blades and the wiper blade to catch liquid developer which drips from the blades. As illustrated in FIG. 2, the edge of sump 25 opposite the edge upon which wiper blade 23 is mounted, is supported by supporting block 24 at point 34 so that the engagement or disengagement of wiper blade 23 with the support surface is controlled by the movement of supporting block 24. Thus, means are provided for simultaneously moving the scraper blade or scraper blades and the wiper blade out of engagement with the support surface, or in the alternative for moving said blades into engagement with said support surface. As noted supra for FIG. 1, when wiper blade 23 causes liquid developer to flow upstream on drum 11, it is preferred that sump 25 extend to the bottom center of the support surface on drum 11 (not shown in FIG. 2).

In addition to providing a method of preventing liquid developer and debris from passing upstream of the wiper blades as described supra for the embodiment of FIG. 1, the dual scraper blade components illustrated in FIG. 2 wherein a second scraper blade is located downstream from the first scraper blade, provide a method of removing streaks of liquid developer from the support surface which remain on the support surface upstream of the first scraper blade due to the solid debris entrained between the first scraper blade and the support surface. This action is described in my copending applications U.S. Ser. No. 473,602 filed May 28, 1974; U.S. Ser. No. 473,535 filed May 28, 1974, now U.S. Pat. No. 3,918,807; and U.S. Ser. No. 482,716 filed June 24, 1974, now U.S. Pat. No. 3,940,282.

The developer liquid remaining on the drum after the transfer station D, together with any foreign matter such as paper fibers reaches the wiper blade 23 first. The characteristics of the wiper blade 23 are such that most of the material passes under the blade unaffected.

The scraper blades 21 in FIG. 1 and 21 and 22 in FIG. 2 then scrape the material from the drum 11 forming a bead at the end surface of each blade. When this bead reaches a certain size, it will fall into the sump or flow down the surface of the drum to the wiper blade 23 which then deflects the flowing material into the sump 25.

Each scraper blade is preferably of polyurethane of 65 Shore A hardness, however, scraper blades having a hardness up to about 90 Shore A or higher are also within the scope of the invention. The scraper blades are preferably about ¾ inch long and 80 thousandths of an inch thick. The blades are clamped in a supporting block 24 preferably over about the first third of their length. The ends of the blades are at 90°. A much smaller angle (such as 60°) at the cutting edge leads to failure by the edge becoming tucked under the blade by friction. The holder of the blades extends at $20° \pm 5°$ to the tangent to the drum at the point of contact (a wider variation of angle being possible to suit different combinations of blades, liquids and drum surfaces), the blade preferably being slightly flexed against the drum in operation by the supporting block 24, with a force of the order of 10 grams per centimeter. In accordance with the present invention, it is preferred that the scraper blades have a rectangular longitudinal cross section.

Wiper blade 23 is preferably a 125 $\mu$m blade, for example, of polyethylene terephthalate, only very slightly flexed against the support surface of drum 11. Suitable wiper blade materials, sizes and position angles may be chosen by one skilled in the art. Suitable non-metallic flexible cleaning blade materials are described by Royka et al in U.S. Pat. No. 3,552,850 at column 14. Stiffener plates and other improvements known and described in the art can be used in mounting the wiper blades.

As used in this invention the distinction between scraper blade and wiper blade set out supra in the background of the invention is critical.

In accordance with the stated objects, the present invention provides a suitable apparatus and method for cleaning liquid developer from s surface capable of carrying electrostatic latent images, and the removal of liquid developer from reusable surfaces is improved when scraper blades are used as cleaning blades at the uphill portion of the reusable surface. While this invention has been described with reference to the structures and method steps disclosed herein, it is not confined to the details set forth; and this application is intended to cover such modifications or changes as may come within the purposes of the improvements or the scope of the following claims.

What is claimed is:

1. A method of cleaning liquid developer and debris from the uphill portion of a moving support surface in an electrostatographic apparatus comprising contacting the moving support surface having liquid developer thereon with a wiper blade and thereafter contacting the uphill portion of the support surface with at least one scraper blade downstream of the wiper blade to remove residual liquid developer and solid debris from said support surface, the scraper being a blade having a stem extending towards the tip of the blade in contact with the surface in the upstream direction of motion of the surface and the wiper being a blade having a stem extending towards the tip in contact with the surface in the downstream direction and pressed against the surface so that it is bent along its length in the downstream direction.

2. The method of claim 1 further comprising contacting the support surface with a second scraper blade downstream from a first scraper blade to remove streaks of liquid developer from the support surface which have passed between the first scraper blade and the support surface due to the solid debris entrained between said first scraper blade and the support surface.

3. The method of Claim 1 wherein the scraper blades are of polyurethane of below 95 Shore A hardness.

4. The method of claim 1 comprising collecting the liquid developer removed from the support surface in a sump as the liquid developer accumulates on said surface and blades and drips therefrom.

* * * * *